United States Patent [19]

Lively

[11] 4,380,091

[45] Apr. 19, 1983

[54] CONTROL CIRCUITRY FOR WATER LEVEL CONTROL OF POOLS

[76] Inventor: Olin A. Lively, 11821 Welch Rd., Dallas, Tex. 75234

[21] Appl. No.: 213,322

[22] Filed: Dec. 5, 1980

Related U.S. Application Data

[63] Continuation of Ser. No. 960,585, Nov. 13, 1978, abandoned.

[51] Int. Cl.[3] ..... E04H 3/16; E04H 3/18

[52] U.S. Cl. ..... 4/508; 4/507; 137/386; 137/391; 137/392

[58] Field of Search ..... 4/488, 496, 506–510, 4/512; 137/386, 391, 392, 403; 340/506, 511, 566, 618, 620; 73/304 C; 141/128

[56] References Cited

U.S. PATENT DOCUMENTS

| | | | |
|---|---|---|---|
| 2,793,653 | 5/1957 | Payne | 137/403 |
| 2,885,118 | 5/1959 | Remko | 137/391 |
| 3,020,924 | 2/1962 | Davies | 137/386 |
| 3,291,149 | 12/1966 | Atkins et al. | 137/392 X |
| 3,386,107 | 6/1968 | Whitten, Jr. | 4/508 |
| 3,537,111 | 11/1970 | Whitten, Jr. | 4/508 |
| 3,605,798 | 9/1971 | Green et al. | 137/392 |
| 3,668,713 | 6/1972 | Baker | 4/512 |
| 3,732,556 | 5/1973 | Caprillo et al. | 340/566 |
| 3,739,405 | 6/1973 | Schmidt | 4/508 |
| 3,757,317 | 9/1973 | Kahn | 137/392 |
| 3,759,286 | 9/1973 | Page | 137/392 |
| 3,837,015 | 9/1974 | Whitaker | 4/508 |
| 3,848,627 | 11/1974 | Page | 137/392 |
| 3,882,967 | 5/1975 | Gulla et al. | 137/392 |
| 3,916,961 | 11/1975 | Dilger | 141/128 X |
| 3,939,360 | 2/1976 | Jackson | 73/304 C |
| 3,942,247 | 3/1976 | Lienau et al. | 340/566 X |
| 3,953,843 | 4/1976 | Codina | 340/566 X |
| 4,061,442 | 12/1977 | Clark et al. | 137/392 |
| 4,133,059 | 1/1979 | Baker | 4/508 |
| 4,135,548 | 1/1979 | Sears | 137/392 |
| 4,165,509 | 8/1979 | Betts et al. | 340/620 |
| 4,211,249 | 7/1980 | Richards | 4/508 X |
| 4,265,598 | 5/1981 | Brand | 4/508 X |
| 4,342,125 | 8/1982 | Hodge | 4/508 |

*Primary Examiner*—Henry K. Artis

*Attorney, Agent, or Firm*—Lockwood, Dewey, Alex & Cummings

[57] ABSTRACT

Circuitry for automatically controlling the water level of swimming pools with a multi-level detecting sensor for directly sensing the pool water. A low voltage oscillator in the input portion of the circuitry detects the presence of water above or below each level sensing electrical contact of the sensor by a change in oscillator amplitude in response to impedance from the contact to ground. Signal threshold circuitry changes in output signal in response to the amplitude of the oscillator signal. Delay circuitry integrates the output of the threshold signal to avoid responding to spurious changes in water level, such as wave action in the pool. Monitor circuitry disposed between the delay circuitry and the water fill, water dump, and pump control circuitry monitors signals received from the sensor or generated by the input circuitry to detect any malfunctions in the sensor or the control circuitry, such as improper sequence of the water level signals, to disable further filling of the pool. Bi-stable switch circuitry controls filling of the pool and is responsive to differing pool levels to cause filling of the pool to commence or to stop.

22 Claims, 3 Drawing Figures

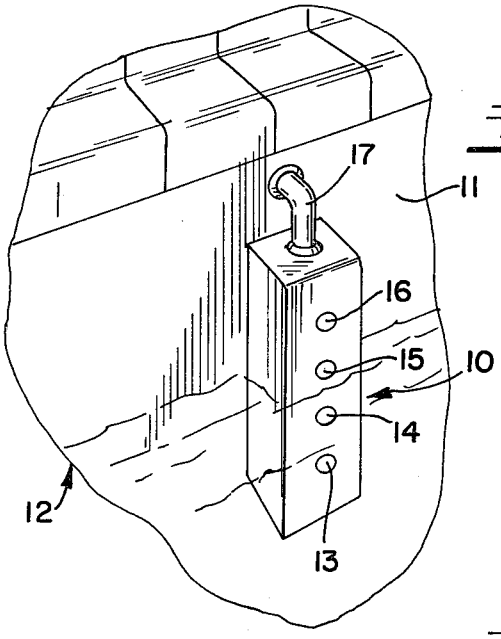
FIG. 1
FIG. 2
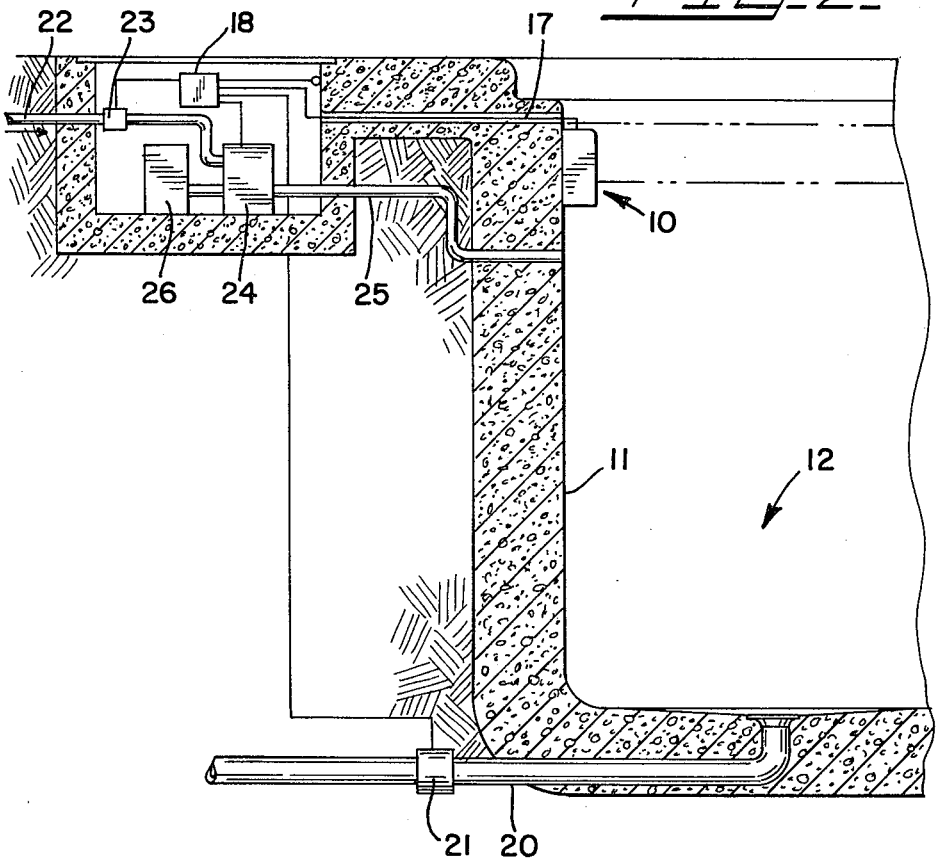

CONTROL CIRCUITRY FOR WATER LEVEL CONTROL OF POOLS

This is a continuation of application Ser. No. 960,585, filed Nov. 13, 1978, now abandoned.

BACKGROUND OF THE INVENTION

This invention relates in general to apparatus for sensing and controlling the water level of a swimming pool, and more particularly to control circuitry for automatically controlling the level of water in the swimming pool in response to a plurality of water level sensing positions which directly sense the level of the pool water with the circuitry compensating for wave action in the pool, resistance responsive oscillators detecting the presence or absence of water at each respective sensor level, by a change in magnitude of oscillation, and monitoring circuitry to detect an improper sequence in the signals representative of the sensing levels to disable the water fill means for the pool.

Various means of automatically controlling the water level of a swimming pool are known to the prior art. Many of these water level control systems utilize a water level sensing chamber or tube disposed remotely from the pool to eliminate spurious detection of abnormally high or abnormally low water level conditions due to the wave action of the water in the pool such as those caused by swimmers, weather or other disturbances to the surface of the water. These isolated or remote sensing tubes or chambers must be specially constructed to accurately reflect the water level in the pool and yet effectively eliminate disturbances in the pool water level. A tube or conduit of narrow internal diameter is often provided for this purpose to limit the amount of water communicating between the pool and the sensing chamber. However, due to its small internal diameter, such tubes are prone to plugging or other blockage by debris which falls into the pool and control over the level of the water in the pool is thereafter lost. Other limitations of the sensing chamber, such as water leakage or improper venting, also reduce the reliability of sensing the pool level in this manner.

Reliability problems often occur with electronically sensing and controlling the water level of a pool. It is usually desirable to have the control circuitry at a location in proximity to the pool to avoid lengthy routing of wiring to or from other components of the water level control system. The control circuitry is therefore often located relatively close to the pool in a location which not infrequently becomes damp or experiences high humidity levels. Malfunctions in electronic circuitry can often occur under high humidity conditions, especially where sensing of the water level is dependent upon measuring of the impedance at a probe or contact. Such a malfunction can cause the circuitry to incorrectly operate the water fill valve, the water dump valve or the water circulating pump to result in an undesired pool water level.

It is therefore a principal object of the present invention to provide novel and improved control circuitry adapted to directly sense and more effectively control the water level in the swimming pool.

Another object of the invention is to eliminate spurious water level signals which are caused by wave action or other water surface disturbance such that the water fill or dump apparatus is not intermittently activated or de-activated.

Yet another object is to provide for sensing of the water level by means of a low voltage A.C. signal generated by a resistance responsive oscillator which changes in oscillator signal amplitude in response to the presence or absence of water at an associated electrode contact of the sensor.

Another object of the invention is to provide water level sensing and controlling circuitry having a higher reliability than heretofore available.

Further object of the present invention is to provide malfunction detecting circuitry capable of sensing and monitoring the various sensor levels and the sequencing of the electrical signals derived therefrom to disable the swimming pool water fill valve and the water circulating pump upon the occurrence of a malfunction.

These advantages of the invention, and others, including those inherent in the invention are provided by control circuitry adapted for electrical connection to a water level sensor having four vertically spaced apart water level sensing positions, said water levels including, in order of increasing elevation, a low level, a latch level, a normal level, and a high level. A resistance responsive low-voltage A.C. oscillator associated with each of the level sensing positions changes in oscillator signal amplitude to produce a change in output state responsive to the presence or absence of water in the pool at the respective sensor level. Threshold detecting circuitry changes in output in response to the magnitude of the oscillator signal. Delay circuitry in series with each oscillator and threshold detector operates to integrate a change in output state of the threshold detector such that the control circuitry is not responsive to wave action or other disturbance of the water surface in the pool. Water fill and dump conduits are electrically controlled by the control circuitry to fill or dump water from the pool in accordance with the levels sensed by the sensor. A monitoring portion of the control circuitry senses the sequencing and operation of the latch, normal and high sensor levels to disable the water fill conduit upon the occurrence of a control circuitry of sensor malfunction. The circuitry also includes bi-stable switch circuitry for controlling the water fill conduit to begin filling the pool if the water level at the sensor is below the latch level and to stop filling the pool when the water level has reached the normal level. The hysteresis provided by the bi-stable switch causes the water fill means to fill the pool for a given interval of time that it takes for the water to be raised from the latch to the normal level, rather than intermittently. An audible alarm is energized upon sensing a high water level condition and the alarm may be separately disabled.

BRIEF DESCRIPTION OF THE DRAWINGS

Features of the present invention which are believed to be novel and patentable, are set forth with particularity in the appended claims. The invention together with the further advantages thereof can best be understood by reference to the following description taken in conjunction with the accompanying drawings and the several figures in which like reference numerals identify like elements, and in which:

FIG. 1 is a perspective view of the multi-level detecting sensor installed on a sidewall of the swimming pool at the desired water surface level;

FIG. 2 is a sectional view of a typical swimming pool, taken in elevation, illustrating the arrangement of the water fill and dump conduits and schematically illustrating the electrical wiring between the control circuitry, the sensor and other components of the electrical control system in accordance with the present invention.

DESCRIPTION OF THE PREFERRED EMBODIMENT

Figure 3:
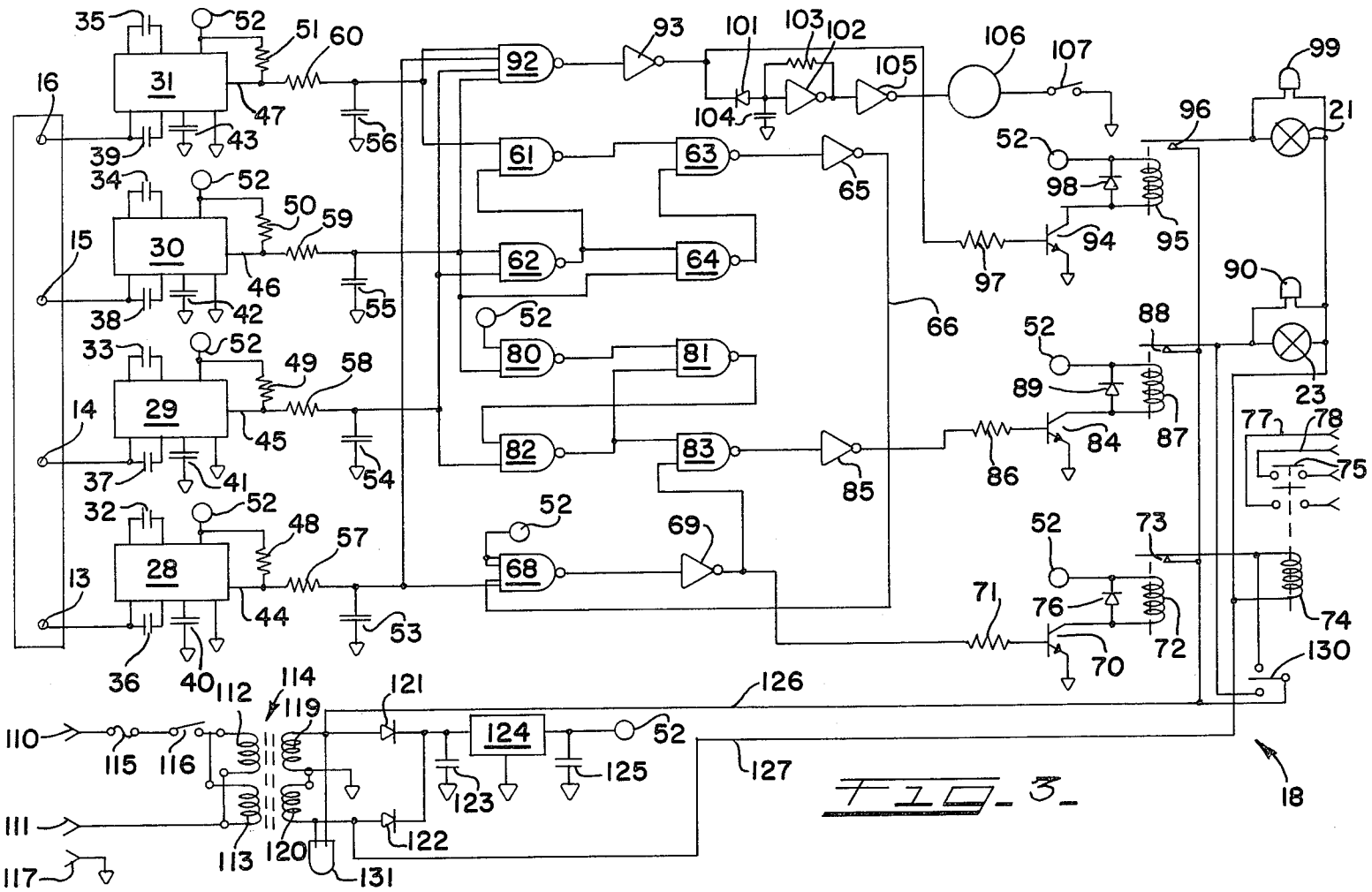
FIG. 3 is an electrical schematic diagram of the electronic control circuitry of the present invention including the electrical connections to the multi-level detecting sensor and to the electrical controls for the electrically actuated dump or fill valves and the water circulating pump.

Referring to FIGS. 1 and 2, there is shown a pool water level sensor, generally designated 10, secured to a generally vertically disposed sidewall 11 of a swimming pool 12. The sensor 10 is elongated in the vertical direction and has electrical probes or contacts 13, 14, 15, 16 at spaced vertical positions along an exterior surface of the sensor for detecting the water level in the swimming pool 12. The contacts 13, 14, 15, 16 are preferably of a corrosion resistant metal, such as stainless steel. The contact 13 represents a low water level. The contact 14 represents a latch water level. The contact 15 represents a normal water level. The contact 16 represents a high water level. A multi-conductor electrical cable 17 provides for separate electrical connection from each of the contacts 13, 14, 15, 16 to the control circuitry 18. The sensor 10 must be waterproof to prevent internal wiring in the sensor 10 from contacting water at a different level than the respective contact 13, 14, 15 or 16. To this end, the sensor 10 may be molded from thermoplastic materials which further insures that the connection of the cable 17 at the sensor 10 will also be waterproof.

Water may be emptied or dumped from the pool 12 into a sewer or the like through a conduit 20 in fluid communication with the bottom of the pool 12 in the usual manner. An electrically actuated valve 21 may be disposed in the conduit 20 for this purpose and controlled by the circuitry 18. Another conduit 22 is controlled by an electrically actuated valve 23 to supply water to a pump 24 and thence through conduit 25 into the pool 12 to fill the pool. The conduit 25 may also be used to circulate water in the pool 12 through a filter 26 by means of the pump 24. The pump 24 and the electrically actuated valve 23 are also controlled by the circuitry 18 in a manner which will become more apparent hereinafter. The circuitry 18 is preferably located in the general vicinity of the the valves 21, 23 and the pump 24 to keep electrical wiring lengths to these devices to a minimum.

The control circuitry 18 is schematically illustrated in FIG. 3. Separate integrated circuits 28, 29, 30, 31 are electrically connected to respective level sensing contacts 13, 14, 15, 16 of the sensor 10. The integrated circuits 28, 29, 30, 31 are commercially available from National Semiconductor Corp. and are identified as part number LM1830. Capacitors 32, 33, 34, 35 determine the operating frequency of an internal oscillator in the respective circuits 28, 29, 30, 31. Capacitors 36, 37, 38, 39 are D.C. blocking capacitors which apply the low voltage A.C. oscillator signal of approximately plus or minus two volts magnitude to the respective level sensing contacts 13, 14, 15, 16. The internal oscillators in the circuits 28, 29, 30, 31 are responsive to the impedance seen at the respective sensing contacts 13, 14, 15, 16. The presence of a relatively low impedance, such as that provided by the water level contacting any of the contacts 13, 14, 15, 16, cause additional load on the respective oscillators and either dampen the magnitude of the peak-to-peak oscillation or cease oscillating. Otherwise, the internal oscillators in the circuits 28, 29, 30, 31 continue to oscillate at the nominal peak-to-peak A.C. voltage in the absence of water engagement with the respective level sensing contact. The water in the pool 12 acts as an electrically conducting medium to effectively cause any of the level sensing contacts 13, 14, 15, 16 which engage the water in the pool to remain substantially at ground potential.

A threshold detecting portion of the circuitry in the circuits 28, 29, 30, 31 senses the peak-to-peak magnitude of the oscillator portion of the same circuits. Capacitors 40, 41, 42, 43 associated with the respective circuits 28, 29, 30, 31 filter the output of the detector portions of the same circuits to switch an output transistor contained in the same circuits into either an on or off condition. An output line 44, 45, 46, 47 of each respective circuit 28, 29, 30, 31 has the characteristic of an open transistor collector. Resistors 48, 49, 50, 51 are therefore connected between the respective output lines 44, 45, 46, 47 to a positive voltage supply terminal 52. The resistors 48, 49, 50, 51 act to pull the output lines 44, 45, 46, 47 up in voltage toward that of the positive supply terminal 52 when the output transistor in the respective circuits 28, 29, 30, 31 is in an off condition. When the output transistor of these circuits is in an on condition, the respective output lines 44, 45, 46, 47 will be lowered to nearly ground potential.

In accordance with another aspect of the invention, there is provided delay means in series with at least some of the output lines 44, 45, 46, 47 such that wave action or other disturbance at the surface of the water in the pool 12, which causes intermittent contact with the respective level sensing contacts 13, 14, 15, 16 will not cause the control circuitry 18 to open the electrically actuated valves 21, 23 or energize or deenergize the pump 24 in a similar intermittent manner. Delay capacitors 53, 54, 55, 56 are connected through a respective charge/discharge resistor 57, 58, 59, 60 to the respective output lines 44, 45, 46, 47 of the circuits 28, 29, 30, 31. Preferably, the capacitors 53, 54, 55, 56 and the resistors 57, 58, 59, 60 are selected to provide a delay of approximately ninety seconds after the respective output lines 44, 45, 46, 47 switches to a low potential. When the low output line 44, 45, 46, 47 is in an off or open condition, the timing capacitors 53, 54, 55, 56 charge toward the voltage at the positive supply terminal 52.

In accordance with another aspect of the invention, besides controlling the pump 24 and the valves 21, 23, the control circuitry 18 monitors the level sensing contacts 13, 14, 15, 16 and the signals generated as a result of the presence or absence of water thereat to detect an improper sequence of conditions at the level sensing contacts or in the input portion of the control circuitry. To this end, NAND gates 61, 62, 63, 64 monitor the time-delayed signals representative of the water level at the latch contact 14, the normal contact 15 and the high contact 16. The output signal of gate 64 is inverted by the inverter 65 to provide an output signal on line 66 from the monitoring and sequence detecting circuitry. The signal on line 66 is adapted to disable both the pump 24 and the water fill valve 23 as will become more apparent hereinafter. A disable signal on line 66 will occur if a high level water condition is sensed at contact 16, or generated by the input circuitry associated therewith, if either the latch sensing contact 14 or the normal sensing contact 15 or the circuitry associated therewith does not also sense and determine the presence of water at the contacts 14, 15. The monitoring and sequence detecting circuitry will also provide a disable signal on line 66 if water is sensed or determined at the normal contact 15 without sensing or determining water at the latch contact 14.

When the low level contact 13 fails to detect the presence of water thereat, the output of gate 68 switches to a high state, after the delay provided by discharge of the capacitor 53 through the resistor 57, to cause the output of the inverter 69 to change to a low condition thereby causing transistor 70 to change to a non-conductive state. Resistor 71 limits the base drive of inverter 69 to the transistor 70. When the water level again rises to the low level contact 13, the gate 61 and the inverter 69 assume opposite states to render transistor 70 conductive. Transistor 70 then energizes a relay 72 by conducting current therethrough from the positive supply terminal 52 to close a pair of contacts 73. The contacts 73 are disposed in a low voltage A.C. circuit as will become more apparent hereinafter and cause energization of another relay 74 to close a double-pole switch 75. Switch 75 electrically closes a pair of lines 77, 78 to cause a source of A.C. voltage supply to be applied to the pump 24. It will therefore be appreciated that the absence of water at the low level contact 13, after an appropriate time delay, causes the pump 24 to lose its supply of A.C. power and shut down to prevent damage to the pump 24 which could result from the absence of water in the pool 12 or a low water level therein.

Since the malfunction or improper sequence signal on line 66 is input into gate 68, a malfunction or improper sequence can similarly cause the pump 24 to shut down. The diode 76 across the terminals of the relay 72 protects the transistor 70 from negative voltage spikes caused by rapid change of current in the inductive relay coil when the transistor 70 assumes a non-conductive state.

Gates 80, 81, 82, 83 form a bi-stable switch which is responsive to the latch level contact 14, the normal level contact 15 and the malfunction signal on line 66 to control the electrically actuated water fill valve 23. The cross-coupling of gates 81, 82 forms a bi-stable switch having a first state which causes the water fill valve 23 to open and begin filling the pool upon the absence of water at the latch contact 14 and a second state which causes the water fill valve to shut and terminate filling of the pool upon the presence of water at the normal level contact 15. The bi-stable switch therefore provides hysteresis since once the water level reaches the normal level determined by contact 15, water will not again be added to the pool 12 until the level drops below the latch contact 14. The control circuitry 18 thereby avoids intermittent opening of the water fill valve 23.

The gate 83 combines the malfunction or improper sequence signal on line 66 through the gate 68 and the inverter 69 to prevent opening of the fill valve 23 upon the occurrence of a malfunction or improper sequence. The output of gate 83 is applied to a transistor 84 after first being inverted by inverter 85. Resistor 86 limits base drive to the transistor 84 which is normally in a nonconductive condition. When the water level in the pool 12 drops below the latch contact 14, transistor 84 after a delay assumes a conductive state which energizes a relay 87, closes a pair of contacts 88, and opens the water fill valve 23 to begin filling the pool and restore the pool level to that of the normal level contact 15. A diode 89 across the relay 87 protects the collector of the transistor 84 from potentially damaging negative voltages caused by the inductance of the relay coil when the transistor 84 assumes a non-conductive state. An indicator lamp 90 connected across the electrical means for controlling the water fill valve 23 gives a visual indication of when the water fill valve 23 is open and therefore in a water fill mode.

According to another aspect of the invention, an audible and a visual alarm is provided whenever water is present at all of the water level sensing contacts 13, 14, 15, 16. To this end, a gate 92 has inputs connected to each of the time delayed signals from the level sensing contacts 13, 14, 15, 16 with the output of gate 92 inverted by inverter 93. When the gate 93 switches to a high state, a gating diode 101 ceases conducting and an oscillator circuit including inverter 102, resistor 103 and capacitor 104 begins oscillating at a low frequency, for example 1 Hz., to continuously gate inverter 105 between on and off states. Audio alarm 106 thereby provides periodic bursts of audio sound followed by periodic intervals of silence. A switch 107 in series connection with the alarm 106 provides means for disabling the alarm 106 as when action is being taken to correct the high water level after the alarm has sounded.

At the same time that the inverter 93 activates the audio alarm, the dump valve 21 is beginning to open. The changed output state of inverter 93 renders the transistor 94 conductive to energize a relay 95 and close a pair of contacts 96 for electrical energization and opening of the water dump valve 21 to begin lowering the water level in the pool 12. Diode 98 across the coil of relay 95 prevents the excessive reverse EMF from being applied to the collector of transistor 94 as the transistor 94 assumes a non-conductive state. Indicator lamp 99 gives a visual indication of the open condition of valve 21, and hence a visual alarm of a high water level in the pool 12.

The circuitry 18 also includes a power supply to provide D.C. voltage to some of the circuitry and low A.C. voltage to other portions of the circuitry. A suitable A.C. power source, such as 115 volts A.C., is applied to input terminals 110, 111 to the primary windings 112, 113 of a transformer 114. A fuse 115 and a power ON switch 116 are in series connection with the windings 112, 113 to protect and energize the circuitry 18 in the usual manner. A ground terminal 117 is also provided to the circuitry 18. Secondary windings 119, 120 are in series connection with a grounded center-tap and are rectified by diodes 121, 122 to apply positive D.C. voltage to a filtering capacitor 123. A three-terminal integrated circuit voltage regulator 124 receives the unregulated D.C. voltage from the capacitor 123 and provides a highly regulated and filtered D.C. voltage to the D.C. voltage supply terminal 52. Another capacitor 125 between the output terminal of the regulator 124 and ground provides additional ripple and noise filtering for the power supply.

A pair of lines 126, 127 respectively connected to the secondary windings 119, 120 provide approximately 24 volts A.C. for operation of the relay 74 and to supply power to the electrically actuated fill valve 23 and the dump valve 21. A switch 130 is manually operable to override the automatic operation of the circuitry 18 to independently open the fill valve 23 or to energize the relay 74 which in turn energizes the pump 24.

An indicator lamp 131 across the secondary windings 119, 120 of the transformer 114 gives a visual indication that electrical power is supplied to the circuitry 18.

It will be understood that various changes and modifications may be made without departing from the spirit of the invention as defined in the following claims.

I claim:

1. A system for controlling the level of water in a swimming pool, said system being adapted to control a fill valve to add water to the pool as required, and comprising, in combination:

first water level sensing means positioned in said pool for producing a first output signal indicative of the presence or absence of water at a predetermined latch level within the pool;

second water level sensing means positioned in said pool for producing a second output signal indicative of the presence or absence of water at a predetermined normal level within the pool above said latch level;

control circuit means for opening said fill valve in response to said output signal from said first water level sensing means indicating said water level falling below said latch level, and for closing said fill valve in response to said output signal from said second water level sensing means indicating said water level rising to said normal level; and monitor circuit means responsive to said first and second output signals for disabling operation of said fill valve upon the occurrence of sensing water at said normal level without also sensing water at said latch level.

2. A control system as defined in claim 1 wherein said system is further adapted to control the operation of a pump for circulating water within the pool, and wherein said monitor circuit means disable operation of said circulating pump upon the occurrence of sensing water at said normal level without also sensing water at said latch level.

3. A system for controlling the level of water in a swimming pool, said system being adapted to control a fill valve to add water to the pool as required, and a dump valve for draining water from the pool as required, and comprising, in combination:

first water level sensing means positioned in said pool for producing a first output signal indicative of the presence or absence of water at a predetermined latch level within the pool;

second water level sensing means positioned in said pool for producing a second output signal indicative of the presence or absence of water at a predetermined normal level within the pool above said latch level;

third water level sensing means positioned in said pool for producing a third output signal indicative of the presence or absence of water at a predetermined high level within the pool above said normal level;

control circuit means for opening said fill valve in response to said output signal from said first water level sensing means indicating said water level falling below said latch level, and for closing said fill valve in response to said output signal from said second water level sensing means indicating said water level rising to said normal level; and additional control circuit means for opening said dump valve in response to said output signal from said third water level sensing means indicating said water level rising to said high level.

4. A control system as defined in claim 3 wherein said additional control means open said dump valve only in response to said second and third output signals indicating the presence of water at said normal and high levels, respectively.

5. A control system as defined in claim 4 wherein said additional control means open said dump valve only in response to said first, second and third output signals indicating the presence of water at said latch, normal and high levels, respectively.

6. A control system as defined in claim 3 including monitor circuit means responsive to said first, second and third output signals for disabling operation of said fill valve upon the occurrence of sensing water at said high level without also sensing water at said latch level and at said normal level.

7. A control system as defined in claim 3 wherein said system is further adapted to control the operation of a pump for circulating water within the pool, and including monitor circuit means for disabling operation of said circulating pump upon the occurrence of sensing water at said high level without also sensing water at said latch level and at said normal level.

8. A system for controlling the level of water in a swimming pool, said system being adapted to control a fill valve to add water to the pool as required, and comprising, in combination:

first water level sensing means positioned in said pool for producing a first output signal indicative of the presence or absence of water at a predetermined latch level within the pool;

second water level sensing means positioned in said pool for producing a second output signal indicative of the presence or absence of water at a predetermined normal level within the pool above said latch level;

third water level sensing means positioned in said pool for producing a third output signal indicative of the presence or absence of water at a predetermined low level within the pool below said normal level;

control circuit means for opening said fill valve in response to said output signal from said first water level sensing means indicating said water level falling below said latch level, and for closing said fill valve in response to said output signal from said second water level sensing means indicating said water level rising to said normal level; and additional control circuit means for disabling said fill valve in response to said output signal from said third water level sensing means indicating said water level falling below said low level.

9. A control system as defined in claim 8 wherein said system is further adapted to control the operation of a pump for circulating water within the pool, and wherein said monitor circuit means disable operation of said circulating pump in response to said output signal from said third water level sensing means indicating said water level falling below said low level.

10. A system for controlling the level of water in a swimming pool, said system being adapted to control a fill valve to add water to the pool as required, and a dump valve for draining water from the pool as required, and comprising, in combination:

first water level sensing means positioned in said pool for producing a first output signal indicative of the presence or absence of water at a predetermined latch level within the pool;

second water level sensing means positioned in said pool for producing a second output signal indicative of the presence or absence of water at a predetermined normal level within the pool above said latch level;

third water level sensing means positioned in said pool for producing a third output signal indicative of the presence or absence of water at a predetermined high level within the pool above said normal level;

fourth water level sensing means positioned in said pool for producing a fourth output signal indicative of the presence or absence of water at a predetermined low level within the pool below said latch level;

control circuit means for opening said fill valve in response to said output signal from said first water level sensing means indicating said water level falling below said latch level, and for closing said fill valve in response to said output signal from said second water level sensing means indicating said water level rising to said normal level; and additional control circuit means for opening said dump valve in response to said output signals from said first, second, third and fourth water level sensing means indicating said water level rising above said latch, normal, high and low levels, respectively.

11. A control system as defined in claim 10 including alarm means for alerting an attendant, and wherein said additional control means include actuate said alarm means upon said water level rising above said latch, normal, high and low levels for a predetermined period of time.

12. A system for controlling the level of water in a swimming pool, wherein the surface of the water is subject to repeated disturbances, said system being adapted to control a fill valve to add water to the pool as required, and comprising, in combination:

first water level sensing means positioned in said pool and responsive to the disturbed surface thereof for producing a first output signal indicative of the instantaneous presence or absence of water at a predetermined normal water level within the pool;

first delay circuit means associated with said first water level sensor means and responsive to said first output signal therefrom for producing a first delayed output signal only upon the duration of said first sensor output signal exceeding a first predetermined period of time;

second water level sensing means positioned in said pool and responsive to the disturbed surface thereof for producing a second output signal indicative of the instantaneous presence or absence of water at a predetermined latch water level within the pool below said normal water level;

second delay circuit means associated with said second water level sensor means and responsive to said second output signal therefrom for producing a second delayed output signal only upon the duration of said second sensor output signal exceeding a second predetermined period of time;

said first and second predetermined periods of time being each greater than the average duration of the water surface disturbances; and control circuit means for opening said fill valve in response to said second delayed output signal from said second water level sensor means indicating said water level falling below said latch level, and for closing said fill valve in response to said first delayed output signal from said first water level sensor means indicating said water level rising to said normal level.

13. A control system as defined in claim 12 wherein said first and second water level sensing means each include at least one exposed water sensing electrode mounted on the sidewall of the pool.

14. A control system as defined in claim 12 including system monitoring means for rendering said fill valve inoperative upon said delayed first output signal indicating the presence of water at said normal level and said delayed second output signal indicating the absence of water at said latch level.

15. A system for controlling the level of water in a swimming pool, wherein the surface of the water is subject to repeated disturbances, said system being adapted to control a fill valve to add water to the pool, and a dump valve to empty water from the pool, and comprising, in combination:

first, second and third water level sensing means positioned in said pool and responsive to the disturbed surface thereof for producing first, second and third output signals indicative of the instantaneous presence or absence of water within the pool at predetermined high, normal and low water levels, respectively;

first, second and third delay circuit means associated with said first, second and third water level sensing means and responsive to said first, second and third output signals therefrom, respectively, for producing first, second and third delayed output signals only upon the duration of said output signals exceeding respective first, second and third predetermined periods of time each greater than the average duration of said water surface disturbances; and control circuit means for opening said fill valve in response to said delayed output signal from said third water level sensor means indicating said water level falling below said latch level, and for closing said fill valve in response to said delayed output signal from said second water level sensor means indicating said water level rising to said normal level, and for opening said dump valve in response to said delayed output signal from said first, second and third water level sensing means indicating said water level having risen to said high level.

16. A control system as defined in claim 15 wherein said first, second and third water level sensing means each include at least one exposed water sensing electrode mounted on the sidewall of the pool.

17. A system for controlling the level of water in a swimming pool, wherein the surface of the water is subject to repeated disturbances, said system being adapted to control a water circulation pump, a fill valve to add water to the pool, and comprising, in combination:

first, second and third water level sensing means positioned in said pool and responsive to the disturbed surface thereof for producing first, second and third output signals indicative of the instantaneous presence or absence of water within the pool at predetermined normal, latch and low water levels, respectively;

first, second and third delay circuit means associated with said first, second and third water level sensing means and responsive to said first, second and third output signals therefrom, respectively, for producing first, second and third delayed output signals only upon the duration of said output signals exceeding respective first, second and third predetermined periods of time each greater than the average duration of said water surface disturbances; and control circuit means for opening said fill valve in response to said delayed output signal from said second water level sensing means indicating said water level falling below said latch level, and for closing said fill valve in response to said delayed output signal from said first water level sensing means indicating said water level rising to said normal level, and for interrupting operation of said pump in response to said delayed output signal from said third level sensing means indicating said water level having fallen below said low level.

18. A control system as defined in claim 17 wherein said first, second and third water level sensing means each include at least one exposed water sensing electrode mounted on the sidewall of the pool.

19. A system for controlling the level of water in a swimming pool, wherein the surface of the water is subject to repeated disturbances, said system being adapted to control a water circulation pump, a fill valve to add water to the pool, and a dump valve to empty water from the pool, and comprising, in combination:

first, second, third and fourth water level sensing means positioned in said pool and responsive to the disturbed surface thereof for producing first, second, third and fourth output signals indicative of the instantaneous presence or absence of water within the pool at predetermined high, normal, latch and low water levels, respectively;

first, second, third and fourth delay circuit means associated with said first, second, third and fourth water level sensing means and responsive to said first, second, third and fourth output signals therefrom, respectively, for producing first, second, third and fourth delayed output signals only upon the duration of said output signals exceeding respective first, second, third and fourth predetermined periods of time each greater than the average duration of said water surface disturbances; and control circuit means for opening said fill valve in response to said delayed output signal from said third water level sensing means indicating said water level falling below said latch level, and for closing said fill valve in response to said delayed output signal from said second water level sensing means indicating said water level rising to said normal level, and for opening said dump valve in response to said delayed output signal from said first water level sensing means indicating said water level having risen to said high level, and for interrupting operation of said pump in response to said delayed output signal from said fourth level sensing means indicating said water level having fallen below said low level.

20. A control system as defined in claim 19 wherein said first, second, third and fourth water level sensing means each include at least one exposed water sensing electrode mounted on the sidewall of the pool.

21. Control circuitry for controlling the level of water in a swimming pool, said control circuitry adapted for electrical connection to a water level sensor having four vertically spaced apart water level sensing positions, including in order of increasing elevation, a low position, a latch position, a normal position, and a high position, said sensor being adapted for placement in the swimming pool to directly sense the water level therein, said control circuitry being further adapted to control an electrically actuated water fill valve to add water to the pool and an electrically actuated water dump valve to empty water from the pool, said control circuitry comprising:

input circuitry means for each of said four sensing positions, each of said input circuitry means being responsive to the level of water in the swimming pool at the respective sensing position to produce a change in output state responsive to the presence or absence of water in the pool at the respective sensing position;

delay circuitry means in series with the output of each of said four input circuitry means to provide individual output signals delayed in time from a change in output state of the associated input circuitry means, at least some of said delay circuitry means being adapted to control the electrically actuated water fill or dump valves, whereby said control circuitry is responsive to the water level in the pool, but is not responsive to wave action in said pool; and monitor circuitry means for said latch, normal and high sensing positions to monitor the sequencing of said latch, normal and high levels, said monitor circuitry means being adapted to disable said water fill valve upon the occurrence of sensing water at the high sensing position without sensing water at either the normal sensing position or the latch sensing position.

22. Control circuitry for controlling the level of water in a swimming pool, said control circuitry adapted for electrical connection to a water level sensor having four vertically spaced apart water level sensing positions, including in order of increasing elevation, a low position, a latch position, a normal position, and a high position, said sensor being adapted for placement in the swimming pool to directly sense the water level therein, said control circuitry being further adapted to control an electrically actuated water fill valve to add water to the pool and an electrically actuated water dump valve to empty water from the pool, said control circuitry comprising:

input circuitry means for each of said four sensing positions, each of said input circuitry means being responsive to the level of water in the swimming pool at the respective sensing position to produce a change in output state responsive to the presence or absence of water in the pool at the respective sensing position:

delay circuitry means in series with the output of each of said four input circuitry means to provide individual output signals delayed in time from a change in output state of the associated input circuitry means, at least some of said delay circuitry means being adapted to control the electrically actuated water fill or dump valves, whereby said control circuitry is responsive to the water level in the pool, but is not responsive to wave action in said pool; and monitor circuitry means for said latch, normal and high sensing positions to monitor the sequencing of said latch, normal and high levels, said monitor circuitry means being adapted to disable said water fill valve upon the occurrence of sensing water at the normal sensing position without sensing water at the latch sensing position.

* * * * *